United States Patent [19]

Daye

[11] 4,277,021

[45] Jul. 7, 1981

[54] CLOSED CIRCUIT HEATING SYSTEM

[76] Inventor: Leslie G. Daye, P.O. Box 11, Depauville, N.Y. 13632

[21] Appl. No.: 73,263

[22] Filed: Sep. 7, 1979

[51] Int. Cl.[3] ..... F24D 3/00

[52] U.S. Cl. ..... 237/56; 126/400; 126/110 R; 126/283; 237/12.1

[58] Field of Search ..... 237/50, 55, 54, 8 R, 237/56; 126/101, 110 R, 116, 400; 165/DIG. 2, DIG. 12, 104 S; 122/20 B, DIG. 1

[56] References Cited

U.S. PATENT DOCUMENTS

| | | | |
|---|---|---|---|
| 3,812,903 | 5/1974 | Thomason | 126/400 |
| 4,153,047 | 5/1979 | Dumbeck | 165/104 S |

FOREIGN PATENT DOCUMENTS

| | | | |
|---|---|---|---|
| 571577 | 10/1930 | Fed. Rep. of Germany | 237/50 |

*Primary Examiner*—Henry C. Yuen
*Assistant Examiner*—Henry Bennett
*Attorney, Agent, or Firm*—Charles S. McGuire

[57] ABSTRACT

Fuel is burned in the lower chamber of a furnace with hot products of combustion rising past an air-to-air heat exchanger to an upper chamber to which outside air is supplied for secondary combustion. Air is heated in a compartment above the upper combustion chamber and passes, together with air within the heat exchanger, through a closed circulation system to a duct within a stone-filled heat storage chamber, then to an air-to-water heat exchanger, through the stones in the heat storage chamber and back to the heating compartment and air-to-heat exchanger. Water heated in the air-to-water exchanger is used for space heating purposes, as in baseboard hot water heaters. Some of the heat may also be used to power a heat engine and/or to dry wood to be used as fuel in the lower combustion chamber.

11 Claims, 7 Drawing Figures

CLOSED CIRCUIT HEATING SYSTEM

BACKGROUND OF THE INVENTION

The present invention relates to fuel burning heating systems, and more particularly to systems for optimizing heating efficiency and reducing waste heat particularly as applied to wood fueled heating systems.

With dwindling supplies and rising costs of fossil fuels, much attention has been recently devoted to seeking ways of improving the efficiency of energy consumption for all purposes, among which are residential and other space heating requirements. Although wood is probably the oldest of fuels used for space heating requirements. Although wood is probably the oldest of fuels used for space heating purposes, wood fueled heating systems are notoriously inefficient. Many improvements and innovations have improved the usefulness and efficiency of wood burning and other heating appliances, but further improvements, which it is the principal object of the present system to provide, continue to be sought.

A further object of the invention is to provide a heating system including a furnace having efficient heat exchange means in conjunction with heat storage means and a further air-to-water heat exchanger.

Another object is to provide a heating system wherein wood is burned and the resulting heat efficiently employed for a plurality of purposes including space and domestic hot water heating, drying of wood prior to burning and, optionally, a heat powered engine.

Other objects will in part be obvious and will in part appear hereinafter.

SUMMARY OF THE INVENTION

In accordance with the foregoing objects, the invention contemplates a complete heating system including a fuel burning furnace of special contruction, a heat storage chamber filled with stones or other such heat-retaining materials, an air-to-water heat exchanger and one or more space heaters which receive heated water from the heat exchanger. The furnace includes a lower combustion chamber wherein the fuel is burned, and an upper combustion chamber. The hot products of combustion, including some flammable but unignited gases pass from the lower to the upper combustion gases wherein a supply of outside air is introduced through a multi-orificed pipe to induce secondary combustion, i.e., burning of the flammable but previously unburned products of combustion. An air-to-air heat exchanger is also positioned in the upper combustion chamber. The products of combustion, which may be at extremely elevated temperatures, as when burning wood which is very dry, pass from the upper combustion chamber through a smoke pipe to the atmosphere. The smoke pipe passes through an air heating compartment and gives off radiational heat therein, air in the compartment being heated both by radiation from the smoke pipe and from below through a heat-conducting partition separating the upper combustion chamber from the heating compartment.

Air heated in both the heating compartment and the air-to-air heat exchanger is conducted to a heat storage device in the form of an enclosure filled with stones or other such material conventionally used to absorb and retain heat over relatively extended periods. The hot air duct passes through the heat storage compartment, sometimes transferring heat from the air to the heat storage medium and sometimes the reverse, whereby air in the duct as it leaves the heat storage compartment remains at a relatively constant temperature in spite of fluctuations in heat generaged by combustion once equilibrium conditions have been established.

Upon leaving the heat storage compartment, the heated air passes through a heat exchanger wherein a portion of the heat is transferred to water which is circulated in a continuous path between the heat exchanger and one or more space heating appliances, such as baseboard hot water heaters, wherein heat is given off to room air. Hot air leaving the heat storage chamber may also be used for other purposes such as drying wood to be burned in the furnace and/or powering a Stirling (heat) engine for generation of electricity, etc.

After passing through the water heater (heat exchanger) and other appliances to which it may be supplied, the air is returned to the lower side of the heat storage chamber and allowed to pass through the air space surrounding the stones or other loosely collected heat absorbing materials therein. A return air duct is connected to the upper end of the heat storage chamber and conducts a portion of the air back to the heating compartment at the top of the furnace and a portion to the air-to-air heat exchanger between the lower and upper combustion chambers. Thus, the air used for heating purposes is maintained in a closed circuit, the only outside air supplied being that required to support the primary and secondary combustion in the lower and upper combustion chambers, respectively.

DETAILED DESCRIPTION

Figure 1:
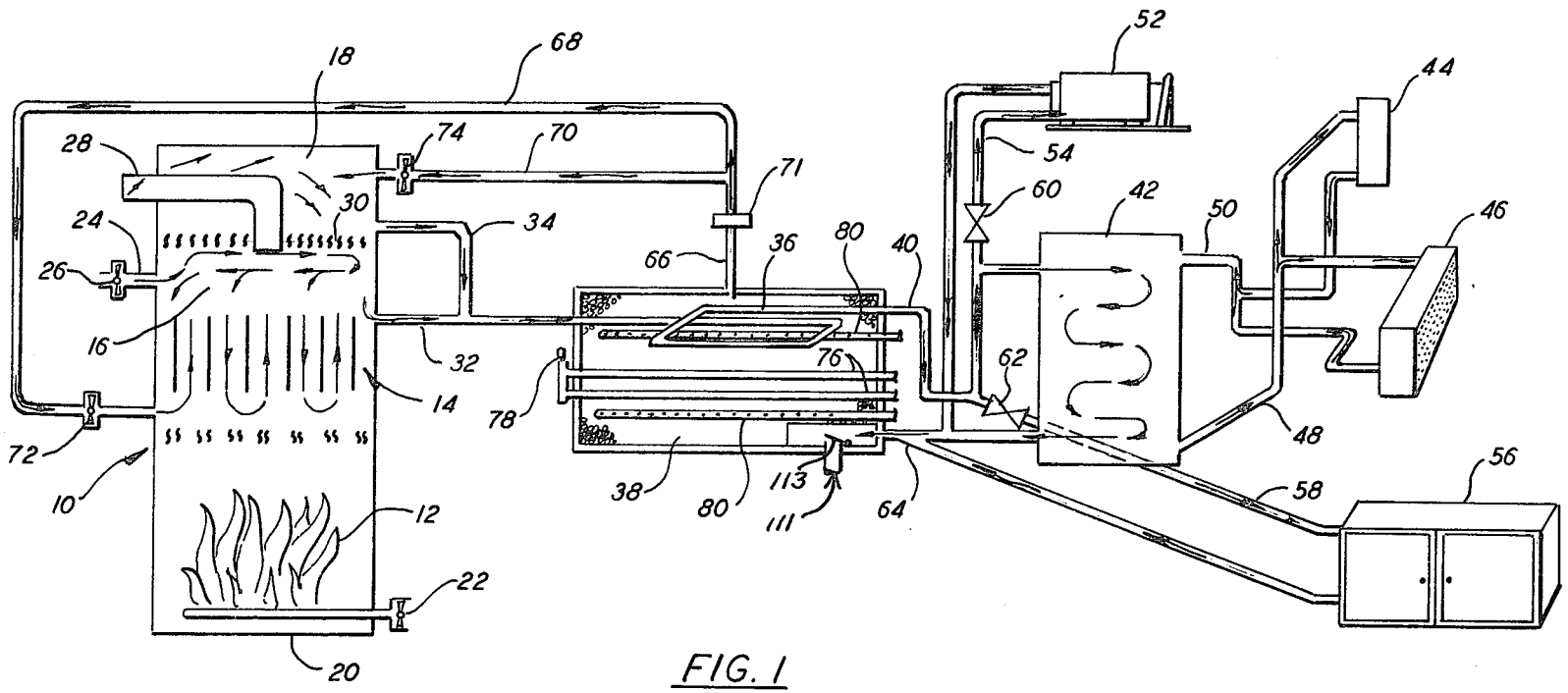
FIG. 1 is a somewhat diagrammatic illustration of a complete heating system constructed according to the invention.

Referring now to the drawings, in FIG. 1 is seen a diagrammatic layout of one form of the complete heating system of the invention. Furnace 10 is of special construction, the interior being shown diagrammatically in FIG. 1 and in more detail in later Figures. Furnace 10 includes lower combustion chamber 12, air-to-air heat exchanger 14, upper combustion chamber 16 and heating compartment 18. Heat utilized in the system is generated by combustion of a conventional fuel in chamber 12, such combustion being supported by outside air introduced through apertured tubes 20, the air flow being augmented by intake fan 20.

Hot gases and other combustion products rise from chamber 12, passing around and imparting heat to the air within heat exchanger 14, which will be described later in more detail. Combustion products from chamber 12 will normally include some flammable components, depending upon the type of fuel used, degree of combustion efficiency in chamber 12, and other factors. The temperature in upper combustion chamber 16 will, under most conditions, be sufficient to ignite the unburned products of combustion, provided sufficient oxygen is present to support the combustion. To this end, outside air inlet tube 24, powered by inlet fan 26, is provided to introduce air into chamber 16 through structure described later in more detail. Thus, secondary combustion takes place in upper chamber 16, to burn effectively all the combustible materials introduced into furnace 10. Between chamber 16 and the discharge end, smoke pipe 28 passes through heating compartment 18, which is separated from upper chamber 16 by heat conducting partition 30. Thus, air within compartment 18 is heated both by conduction through partition 30 and by heat radiated from smoke pipe 28 which will, of course, become quite hot from the gases leaving upper combustion chamber 16.

Hot air from heat exchanger 14 and heating compartment 18 is conducted through insulated ducts 32 and 34 to duct 36 which follows a circuitous path through heat storage chamber 38, which comprises a tank or other such enclosure filled with stones or other solid material conventionally used to absorb and retain heat as disclosed, for example, in U.S. Pat. Nos. 3,709,209 and 2,808,494. The stones or other material within heat storage chamber 38 are of such size and configuration as to provide ample air space, for purposes which will be explained later.

Heat is transmitted through the walls of duct 36 to the material in chamber 38 until an equilibrium condition is reached, i.e., until the temperature of the stones or other material approaches that of the hot air entering duct 36, after which the only heat transferred will be that required to maintain equilibrium doe to fluctuations in combustion, and to replace that absorbed from the heat absorbing material by return air, as also explained later.

Hot air leaving duct 36 is conducted through insulated duct 40 to air-to-water heat exchanger 42. Water flows in a closed circuit between heat exchanger 42 and one or more hot water space heaters, such as conventional baseboard heating units or hot water radiators, indicated diagrammatically in FIG. 1 at 44 and 46. Water heated within exchanger 42 is withdrawn through line 48 for distribution to the space heating units and is returned to the exchanger through line 50 after giving up a portion of its heat to inside air within the rooms or other spaces where units 44 and 46 are located. One or more circulating pumps (not shown) may be provided as required in the water lines, operation thereof being responsive to thermostats in the space being heated, if desired.

Although it is anticipated that the major portion of the heat generated by combustion in furnace 10 will be utilized for space heating purposes, additional heat may be available and is utilized for other purposes. For example, Stirling engine 52, a conventional piece of apparatus powered solely by hot air, may be connected by line 54 to hot air supply duct 40. Also, drying compartment 56 may be connected by line 58 to the hot air supply duct to utilize some of the system heat for drying fuel to be burned in furnace 10. This is especially desirable when wood is the primary fuel used in the system since the amount of heat obtained from burning wood is inversely proportional to its moisture content. Thus, combustion efficiency is greatly improved by pre-drying the wood with heat from the system which might otherwise be wasted. Valves 60 and 62 are provided in lines 54 and 58, respectively, for manual or automatic operation so that heat is supplied to engine 52 and/or compartment 56 only in excess of that required for space heating purposes.

After passing through heat exchanger 42, air which has given up heat to the water is returned through insulated duct 64 to heat storage compartment 38 and released therein to the air space surrounding the stones. Air which has given up heat in engine 52 and compartment 56 is also returned to and released within compartment 38. Air is released from the upper end of compartment 38 into duct 66 and is returned to heat exchanger 14 and heating compartment 18 through insulated ducts 68 and 70, respectively. An air filter, indicated diagrammatically at 71, may be provided in return duct 66 to remove dust or other foreign matter which may be picked up by the air as it passes through compartment 38. Return air fans 72 and 74 keep air circulating through the system as required.

Domestic hot water may also be provided by the heating system through lines 76 passing through and absorbing heat from the material within heat storage chamber 38. In such event, pressure relief valve 78 is preferably provided exteriorly of compartment 38 to avoid dangerous and possibly damaging pressure buildup in the lines due to overheating. Also, one or more apertured lines 80 are positioned inside compartment 38 and connected to an exterior water supply to provide cooling water in the event of heat buildup to a dangerous level.

Figure 3:
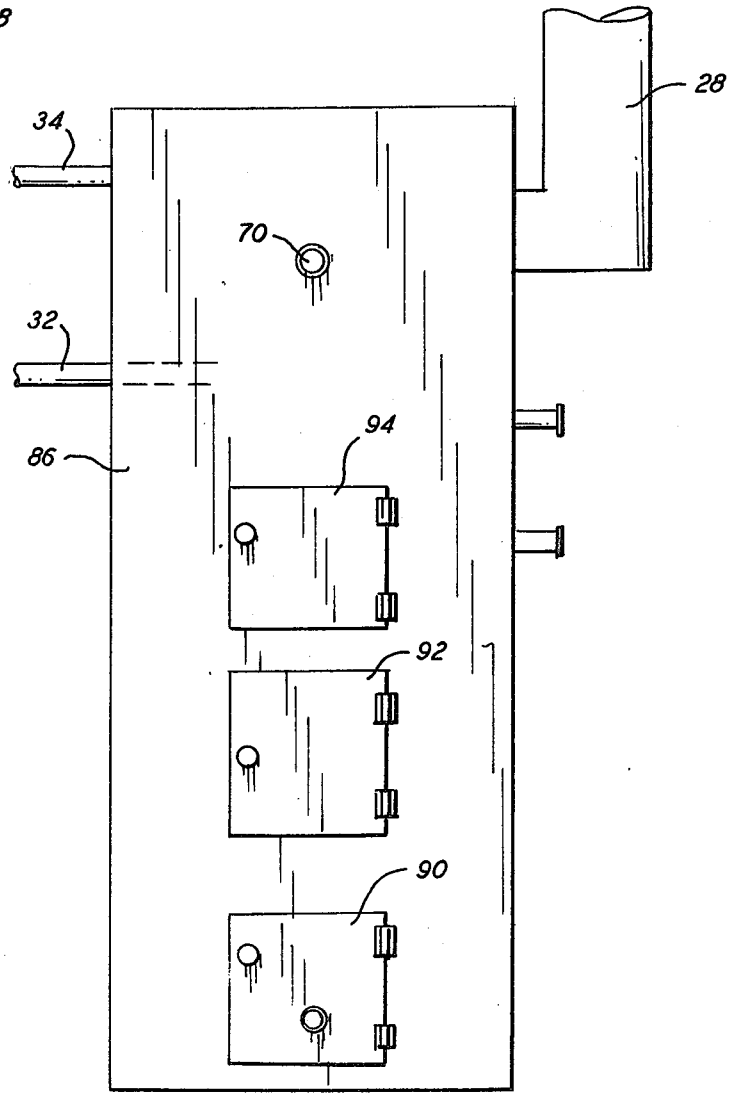
FIG. 3 is a front elevational view of the furnace liner within the jacket of FIG. 2.
Figure 2:
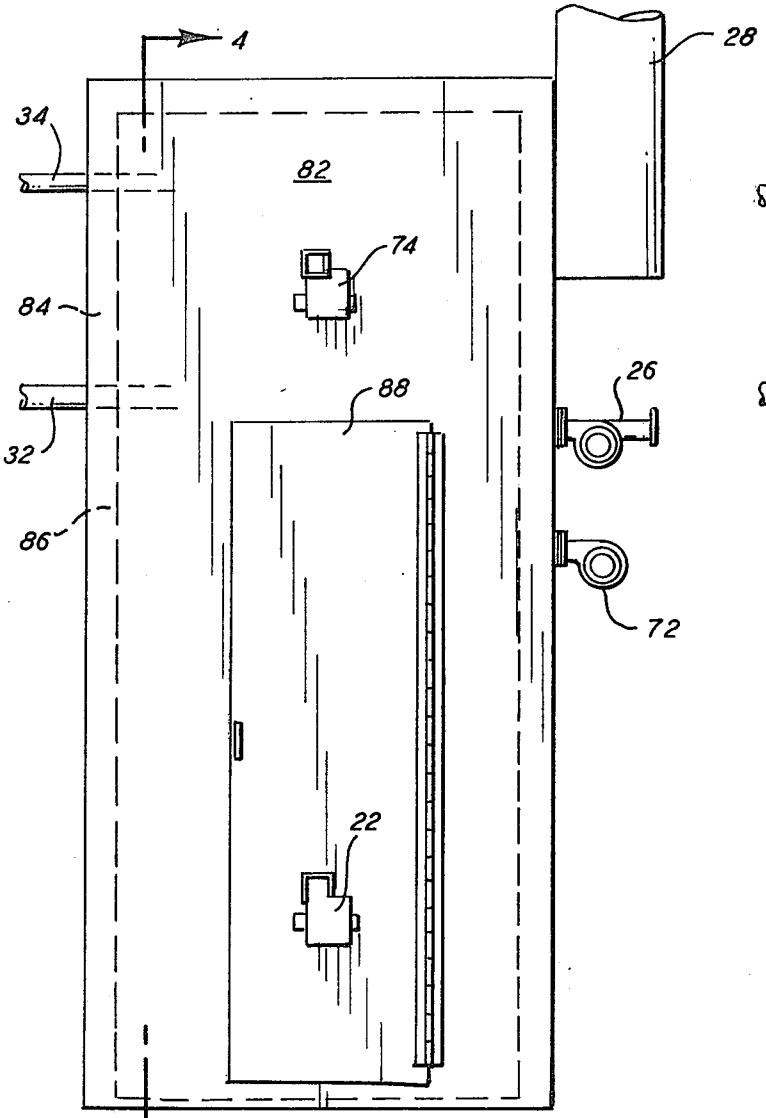
FIG. 2 is a front elevational view of the outer jacket of the furnace unit of FIG. 1.

Turning now to FIGS. 2 and 3, a preferred construction of the outer jacket and inner liner of furnace 10 are shown. Outer jacket 82 is a sealed enclosure of thin sheet metal or the like, with a layer of insulating material 84 between its inside surface and the outer surface of liner 86. Access door 88 is hinged to outer jacket 82 in covering relation to a plurality of doors, preferably three, denoted by reference numerals 90, 92 and 94 at ascending vertical levels on liner 86. Each of doors 90, 92 and 94 communicate with lower combustion chamber 12 and permit loading fuel therein to various levels depending upon the desired intensity of combustion, where solid fuel is used.

Figure 5:
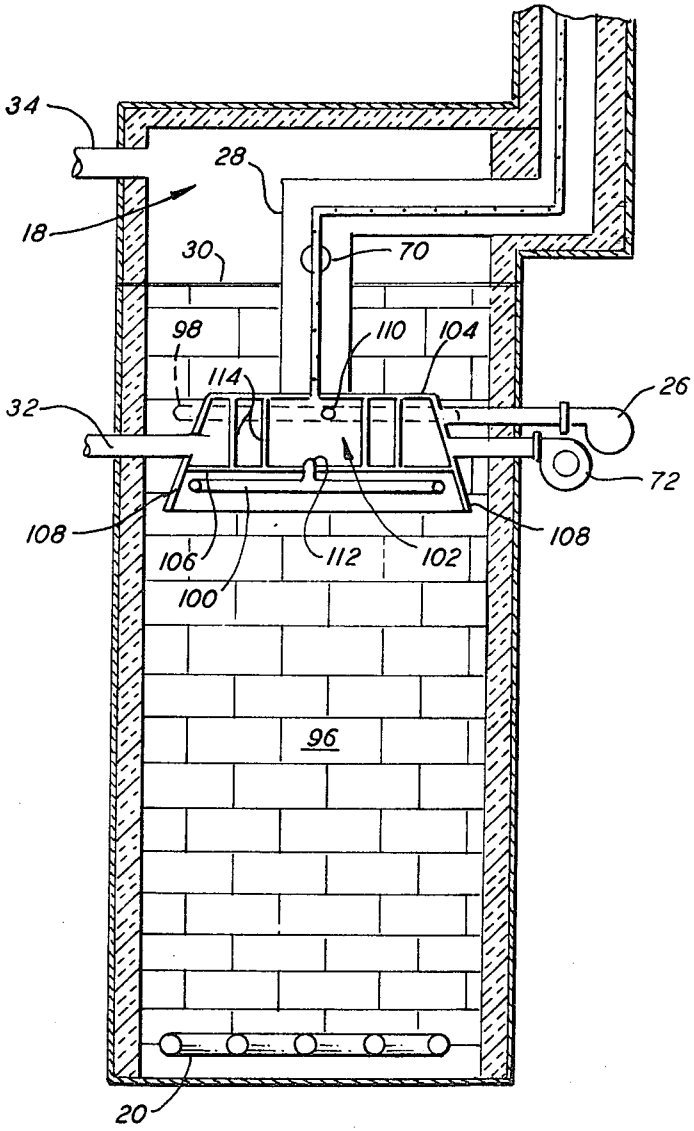
FIG. 5 is a front elevational view of the furnace unit in half-section.
Figure 4:
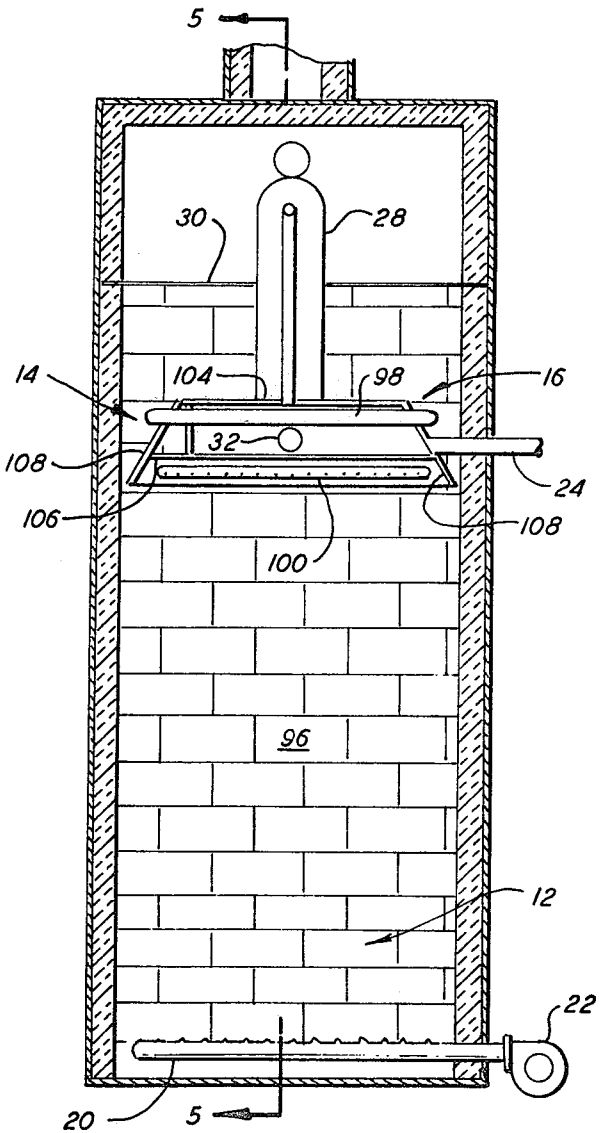
FIG. 4 is a side elevational view of the furnace unit in section on the line 4—4 of FIG. 2.
Figure 7:
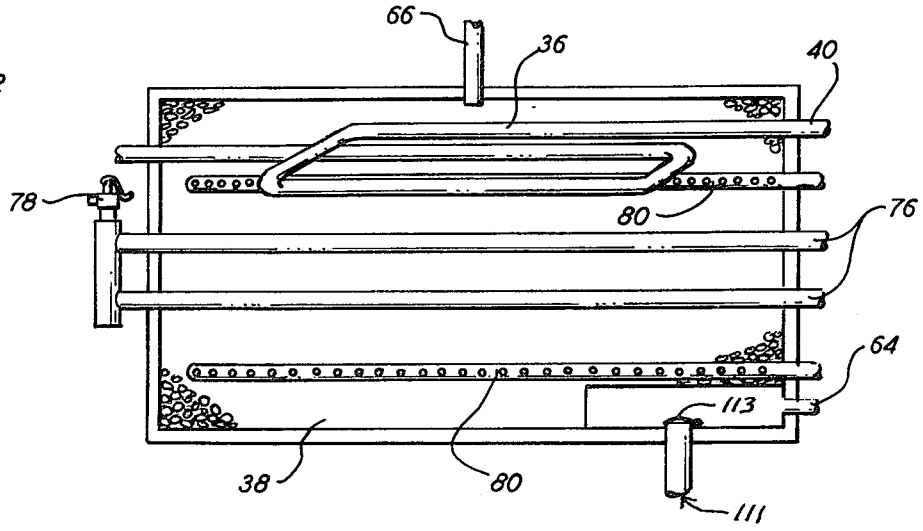
FIG. 7 is an enlarged view of a portion of the system shown in FIG. 1.

The interior of furnace 10 is shown in FIGS. 4 and 5. Liner 86 is constructed of refractory material such as fire brick 96 to define lower and upper combustion chambers 12 and 16, respectively. The liner further provides at its upper end enclosure of previously mentioned heating compartment 18. Air inlet tubes 20 for supporting primary combustion may, if properly supported and of heavy construction, may be used without a covering, fuel-supporting grate, but the furnace preferably includes such conventional grate means (not shown) just above tubes 20.

Figure 6:
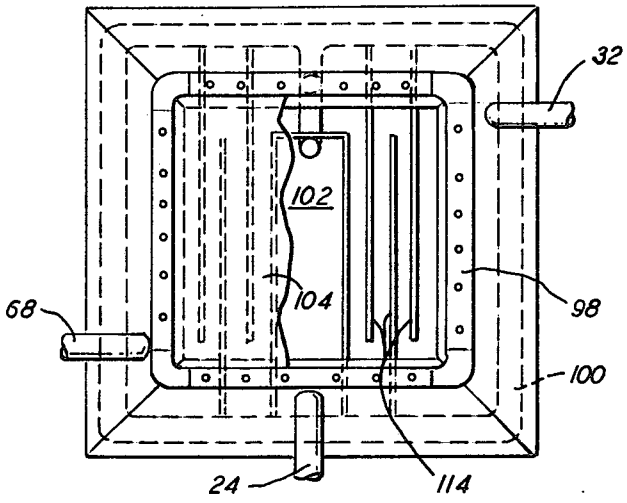
FIG. 6 is a plan view of a portion of the furnace unit, in section on the line 6—6 of FIG. 2, with portions broken away.

Air for supporting secondary combustion in chamber 16 is released through upper and lower, horizontally disposed tubes 98 and 100, respectively, having apertures about the peripheries thereof and each communicating with pre-heating chamber 102 within heat exchanger 14. Air-to-air heat exchanger 14 includes top and bottom walls 104 and 106, respectively, and side walls 108 which slope outwardly in the downward direction to define an enclosed space, surrounding chamber 102 and isolated from the products of combustion within furnace 10. Upper tube 98 is positioned around the upper end of heat exchanger 14 and lower tube 100 is positioned below bottom wall 106 and within a lower extending portion of side walls 108 of heat exchanger 14. Outside air enters chamber 102 through inlet 24 and passes from chamber 102 to tubes 98 and 100 through tubes 110 and 112, respectively, portions of which are seen in FIGS. 5 and 6. Tubes 98 and 100 include a plurality of spaced apertures about their peripheries for discharge of outside air into the hot products of combustion rising from lower combustion chamber 12. The oxygen thus introduced will support combustion of the flammable elements and augment the heat transferred to the air within heat exchanger 14. A system of baffles 114 is disposed within heat exchanger 14 to define a circuitous path for air passing from the inlet (tube 68) to the outlet (tube 32) thereof, thus maximizing heat transfer. A portion of the path brings the air into contact with chamber 102 to pre-heat the air therein prior to its release into combustion chamber 16.

From the foregoing, it is apparent that the heating system of the present invention extracts a very high percentage of the heat from the products of combustion within the furnace. The heat is transferred to air in two, separate, enclosed spaces, both isolated from the products of combustion which are vented through a smoke pipe from which heat is also extracted in one of the enclosed spaces. The heated air is conducted through duct means which serve to transfer heat to a heat absorbing and retaining material such as natural stones within an enclosed tank forming a heat storage chamber until equilibrium conditions are reached, i.e., until the stones are at or near the temperature of the air in the duct passing therethrough. Air leaving the duct means within the air storage chamber passes to an air-to-water heat exchanger where it imparts heat to water used for space heating purposes. Although the water could pass through a pipe directly within the heat storage chamber, the air-to-water heat exchanger is preferably located outside the heat storage chamber for ease of access for maintenance, repair, inspection, etc.

After giving up heat to the water, and for other purposes, where desired, the air is returned to the heat storage chamber and released into the air space surrounding the stones. Thus, as the air passes through the heat storage chamber it picks up some of the heat given up to the water before returning to the two enclosed spaces within the furnace for re-heating. The heat absorbed and retained by the stones during periods of high combustion in the furnace allows normal heating cycles to continue after combustion has diminished and for some time when no combustion takes place. System operation, therefore, is not dependent upon a steady, or even continuous, rate of combustion and heat generation within the furnace. These features combine to provide a heating system of optimum efficiency, safety and economy of operation.

Make-up air may be automatically provided to the system if required, for example, by internal pressure variation, through opening 111 in a wall of heat storage chamber 38, under the control of one-way valve 113.

What is claimed is:

1. A heating system comprising:

(a) a fuel-burning furnace having at least one outlet for a supply of air heated by-products of combustion therein:

(b) a heat storage chamber including an enclosure containing a heat absorbing and retaining material with substantial surrounding air space;

(c) first duct means conducting said supply of air from said furnace to and through said heat storage chamber for mutual heat exchange between said air and said material;

(d) an air-to-water heat exchanger positioned exteriorly of said heat storage chamber wherein heat from said air is transferred to water passing through said exchanger;

(e) at least one space heating means through which water flows to give up heat to room air, said water flowing in a continuous path between said exchanger and said space heating means;

(f) second duct means conducting air from said air space surrounding said material in said heat storage chamber to said furnace for re-heating therein;

(g) a smoke pipe for venting said products of combustion from said furnace;

(h) third duct means for conducting said supply of air from said heat storage chamber to said heat exchanger; and (i) fourth duct means for conducting said supply of air from said heat exchanger back to said heat storage chamber.

2. The invention according to claim 1 wherein said heat storage chamber comprises a substantially air-tight enclosure.

3. The invention according to claim 2 wherein said heat absorbing and retaining material comprises natural stones.

4. The invention according to claim 1 wherein said first duct means connect directly with said third duct means, and said fourth duct means discharges into said air space surrounding said material in said heat storage chamber, whereby said supply of air flows in a substantially closed circuit between said furnace, heat storage chamber and heat exchanger.

5. The invention according to claim 1 wherein said furnace includes lower and upper combustion chambers, an air-to-air heat exchanger, and a separate air heating compartment, said air-to-air heat exchanger and compartment each having interiors isolated from and heated by said products of combustion.

6. The invention according to claim 5 wherein said supply of air is conducted from both said air-to-air heat exchanger and said heating compartment through said first duct means to said heat storage chamber.

7. The invention according to claim 11 wherein a first portion of said air conducted through said second duct means is returned to said air-to-air heat exchanger and a second portion is returned to said heating compartment.

8. The invention according to claims 5, 6 or 7 wherein said smoke pipe communicates at one end with said upper combustion chamber and at the other end with atmosphere, and includes a portion passing through said heating compartment intermediate of said ends.

9. A heating system comprising:

(a) a fuel-burning furnace having a lower combustion chamber wherein fuel is burned, an upper combustion chamber wherein flammable products of combustion from said lower chamber are burned, combustion-supporting air inlet means in both of said lower and upper combustion chambers, and at least one outlet for a supply of air heated in said furnace;

(b) a heat storage chamber including an enclosure containing a heat absorbing and retaining material with substantial surrounding air space;

(c) first duct means conducting said supply of air from said furnace to and through said heat storage chamber for mutual heat exchange between said air and said material;

(d) an air-to-water heat exchanger wherein heat from said supply of air is transferred to water passing through said exchanger;

(e) at least one space heating means through which water flows to give up heat to room air, said water flowing in a continuous path between said exchanger and said space heating means;

(f) second duct means conducting air from said air space surrounding said material in said heat storage chamber to said furnace for re-heating therein;

(g) an enclosed heating compartment within said furnace having an interior isolated from said products of combustion and wherein said supply of air is heated thereby, said first and second duct means providing the outlet and inlet, respectively, for said compartment; and (h) a smoke pipe for venting said products of combustion from said furnace.

10. The invention according to claim 9 wherein said first and second air inlet means each comprise at least one tube communicating at one end with outside air and having a portion disposed inside said furnace with a plurality of discharge apertures for distributing said combustion-supporting air throughout said lower and upper combustion chambers.

11. The invention according to claim 10 wherein said heating compartment is positioned directly adjacent said second air inlet means.

* * * * *